United States Patent [19]

Hutchings et al.

[11] 4,146,335

[45] Mar. 27, 1979

[54] CONTAINERIZED SOLIDS MIXING MACHINE

[75] Inventors: William F. Hutchings, Fairport; Horst P. Engelbrecht, Canandaigua; William J. Montagno, Rochester, all of N.Y.

[73] Assignee: General Signal Corporation, Rochester, N.Y.

[21] Appl. No.: 888,600

[22] Filed: Mar. 20, 1978

[51] Int. Cl.[2] ..... B01F 9/00

[52] U.S. Cl. ..... 366/217; 366/239

[58] Field of Search ..... 366/208–217, 366/220, 180, 239; 51/163.1, 163.2, 164

[56] References Cited

U.S. PATENT DOCUMENTS

| | | | |
|---|---|---|---|
| 2,304,734 | 12/1942 | Kantor | 366/217 |
| 3,018,092 | 1/1962 | Johnson | 366/216 |
| 3,374,584 | 3/1968 | Haught | 51/164 |
| 3,421,053 | 1/1969 | Rinard et al. | 366/217 X |
| 3,880,408 | 4/1975 | Karjalainen | 366/217 |

*Primary Examiner*—Leonard D. Christian

*Attorney, Agent, or Firm*—Martin LuKacher; Jeffrey S. Mednick

[57] ABSTRACT

A machine for mixing solids in portable containers, such as shipping containers, is provided with a drive station which has a mechanism for holding the containers at one end thereof and contains motors and associated drive elements for revolving the container continuously about a generally horizontal axis. The entire drive station is pivotable about another axis which is perpendicular to the axis about which the container and holding mechanism revolves by actuators which are spaced on the opposite side of the drive station from the holding mechanism. The arrangement makes efficient use of factory floor space and provides an opening in the holding mechanism almost entirely around the front of the machines so as to facilitate loading and unloading of containers. The holding mechanism preferably is a clamp structure mounted as a cantilever which applies essentially compressive forces via the top and bottom of the container to the side walls thereof thus eliminating the need for cradles and special appliances or container wall constructions in order to secure the container for rotation.

20 Claims, 4 Drawing Figures

FIG. 2
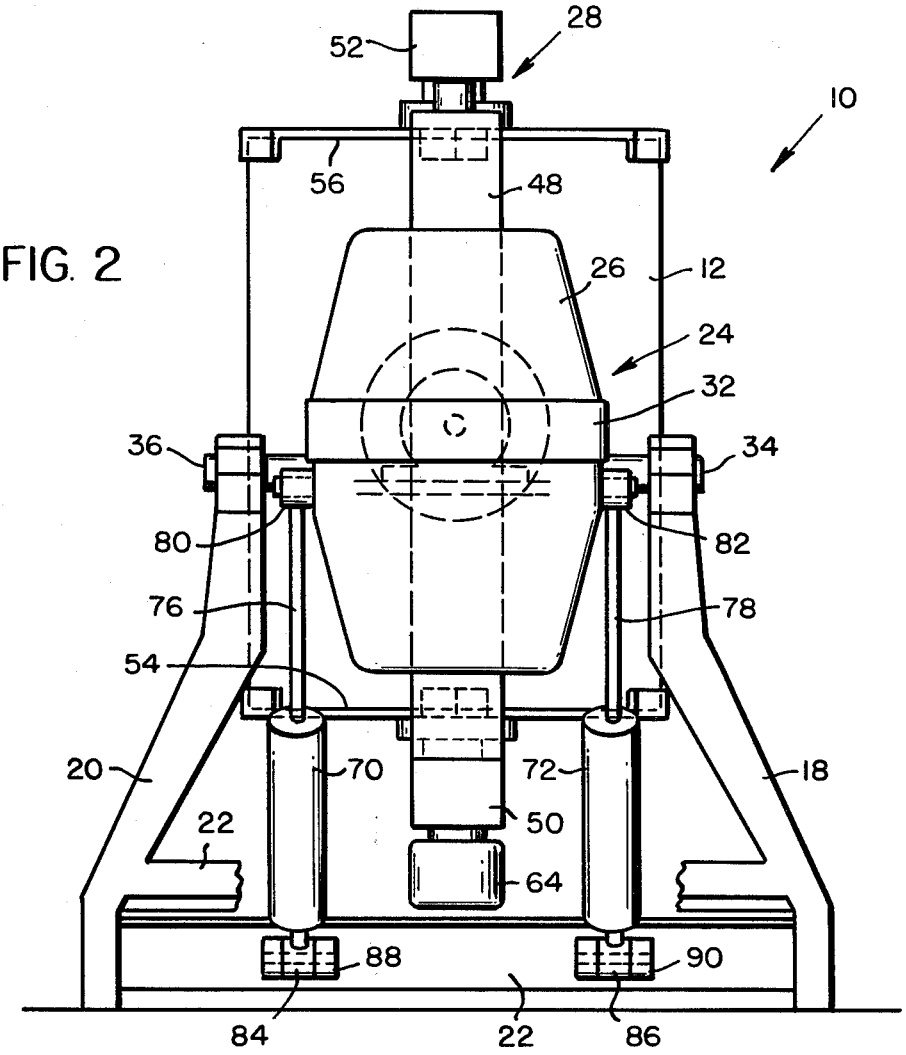
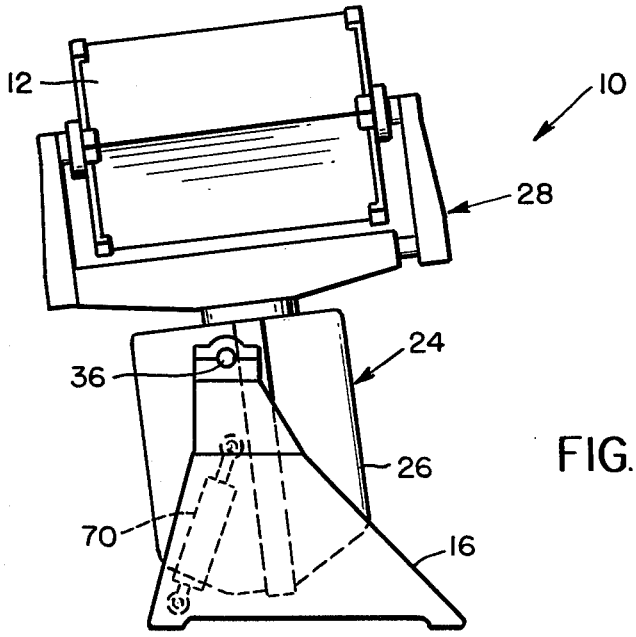
FIG. 3

CONTAINERIZED SOLIDS MIXING MACHINE

BACKGROUND OF THE INVENTION

The present invention relates to mixing machines in which solids carried in portable containers may be mixed while in their containers.

The invention is especially suitable to dry mixing of powders or other solids in a portable container in which the solids may be transported. These containers may be shipping containers or process containers in which the solids are transported in the course of batch processing operations. Liquids may also be mixed with the powders or other solids in a machine embodying the invention.

The mixing of materials is usually carried out with the aid of a separate mix tank or vessel. This tank may be rotated and oscillated (see U.S. Pat. No. 1,143,268 of June 15, 1915). It has also been the practice to mix liquids, usually paint, in their shipping cans through the use of shaker machines (see U.S. Pat. Nos. 1,429,652 of Sept. 19, 1922, RE 21,973 of Dec. 9, 1941; 2,323,403 of July 6, 1943; and 2,527,556 of Oct. 31, 1950). Such shakers are used with small cans. Where large containers carry the materials to be mixed, problems are presented in loading and unloading the containers from the mixing machine and in securely holding the containers so that they can be revolved and held at selected angles of inclination which facilitate solids mixing and blending. To solve these problems containerized mixing machines have used cradles for holding containers (see U.S. Pat. No. 2,868,519 of Jan. 13, 1959). Other approaches have been the use of containers having specialized wall structure (see U.S. Pat. No. 4,050,580 of Sept. 27, 1977). In order to tilt the container gimbal-like structures have been used (see U.S. Pat. No. 2,868,519 and 4,050,580). In one dry mixing machine marketed by Hoover Ball and Bearing, a cradle for the container is mounted in trunnions held on a superstructure which is tilted about one end. The cradle arrangements are difficult to load since there is limited accesss to the cradle. Loading and unloading is still further complicated by the trunnion design in that the trunnions and their superstructure can interfere with the lift truck unless great care is exercised. Moreover, the trunnion design is not well adapted for the selection of different angles of inclination or tilt which are needed for optimum mixing of different solids, for example powders of different materials and fineness.

Accordingly it is an object of the present invention to provide an improved machine for mixing solids in portable containers which has an assembly of elements integrated with each other so as to facilitate loading and unloading of the containers into the machine so that they can be revolved to mix the solids and tilted to selected angles of inclination.

It is another object of the invention to provide an improved containerized solids mixing machine having a driving station where the containers are revolved so as to mix the solids therein and in which the containers may be tilted to selected angles of inclination wherein the means for holding and tilting the containers are arranged in a manner which conserves the use of factory floor space.

It is a further object of the present invention to provide an improved machine for mixing solids while in portable containers by revolving the containers which enable the containers to be held securely without the need for special appliances such as cradles and bands although permitting the use of such appliances, if desired.

It is a still further object of the present invention to provide an improved machine for mixing solids while in portable containers by revolving the containers wherein the containers are held essentially entirely by compressive forces applied from the top and bottom to the side walls thereof where the containers are structurally the strongest.

It is a still further object of the present invention to provide an improved machine for mixing solids in portable containers which has a driving station where the loading of containers and the driving and tilting thereof is carried out at opposite ends of the station to permit more efficient operation.

It is a still further object of the invention to provide an improved machine for mixing solids in their portable containers in which the driving elements, such as motors and gears are enclosed and located away from the containers.

It is a still further object of the invention to provide an improved machine for mixing solids in portable containers which can handle containers of very large size, say 60 to 100 cubic feet capacity.

It is a still further object of the present invention to provide an improved machine for mixing solids in portable containers which can be provided with means for revolving the container about a vertical axis as well as a horizontal axis and with means or tilting the container about another horizontal axis which is mutually perpendicular to the axis about which the container is revolved.

It is a still further object of the present invention to provide an improved containerized solids mixing machine which can be manufactured at lower cost than other machines which attempt to provide operating features similar thereto.

Briefly described, a solids mixing machine embodying the invention is designed for use with portable containers in which the solids to be mixed are carried. The machine has a base and a drive station. The drive station has a housing. A holding mechanism removably secures the containers to the housing. The holding mechanism is rotatably mounted to the housing at one end of the housing. Motor means in the housing rotate the holding mechanism so that the mechanism and the containers are revolved about a generally horizontal axis. The entire drive station is pivotally mounted on the base which may be arranged to provide a stanchion in which the drive station is journalled along an axis generally perpendicular to the axis about which the container and the holding mechanism are revolved. In order to tilt the drive station for selecting the angle of inclination of the container which is desired to improve the mixing action for the particular solids therein, means, such as actuators connected between the base and the housing are provided. These actuators operate to pivot the entire drive station. The location of the holding mechanism at one end, which may be the front end, of the machine provides access almost entirely around the front end of the machine for loading and unloading. The housing is on the opposite side of the pivot mounting from the container holding mechanism. This enables the machine to be counterbalanced. The housing may be an enclosure for the motors and thus protects the containers as well as assisting in reducing the emission of noise from the machine. The assembly is of compact design thus making efficient use of floor space in the factory. The design is also adapted for use with containers having a large range of sizes and models of the same design as handle relatively small containers (e.g., 1 cubic foot) may be constructed of large size to handle very large containers (e.g., 100 cubic feet).

The foregoing and other objects and advantages of the invention as well as the presently preferred embodiments thereof, will be more apparent from a reading of the following description in connection with the accompanying drawings in which:

FIG. 2 is an end view of the machine shown in FIG. 1. The view being taken from the right side of FIG. 1;

FIG. 3 is a diagrammatic side view illustrating the machine shown in FIG. 1 and 2 in tilted position.

Figure 1:
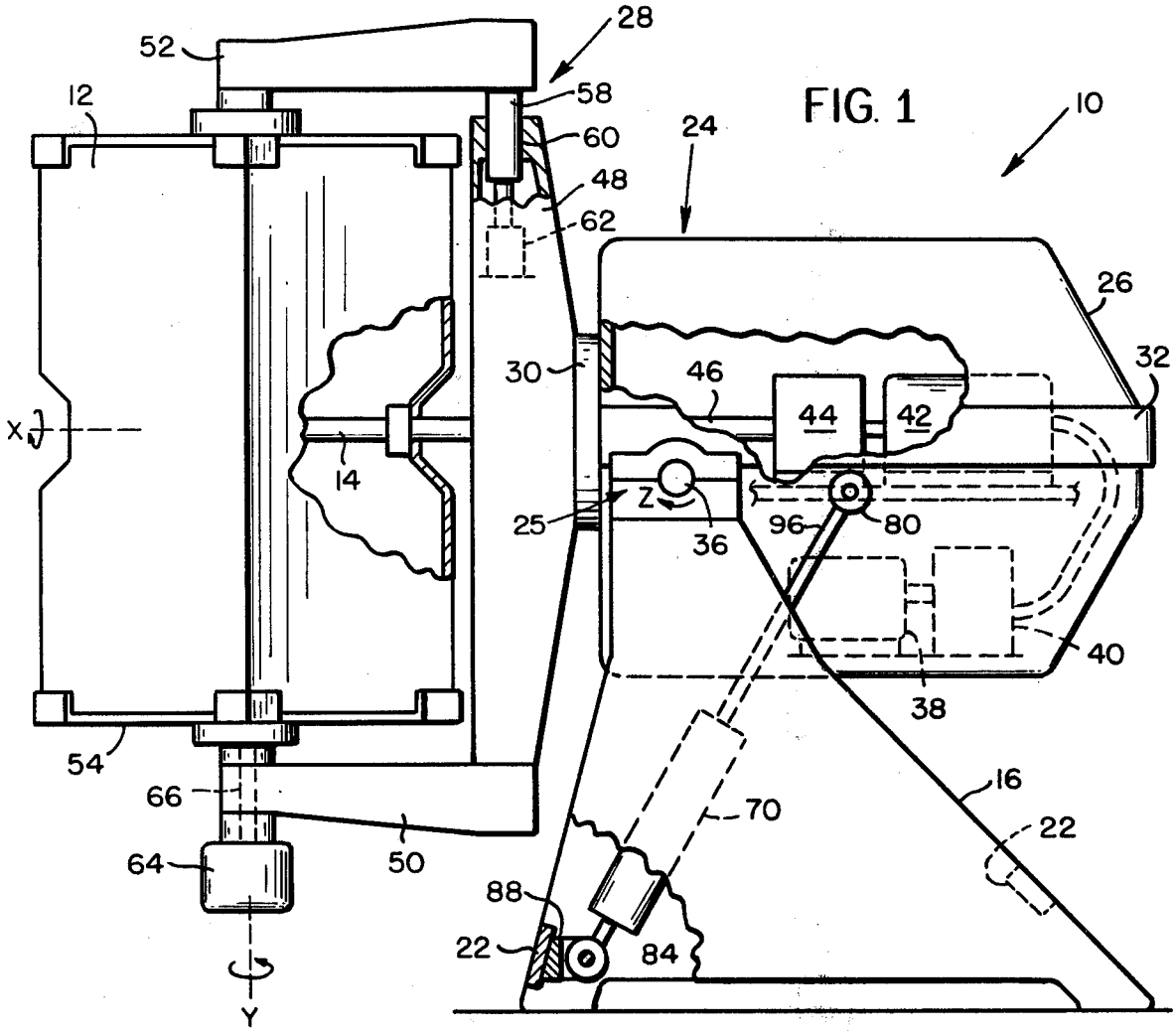
FIG. 1 is a side view, partially broken away, which illustrates a solids mixing machine embodying the invention.

Referring more particularly to FIGS. 1 and 2 of the drawings, there is shown a solids mixing machine 10 in which materials are mixed while in their containers. A rectangular container 12 is shown loaded into the machine. It is a feature of the invention that the machine is capable of handling conventional containers which may be rectangular or cubic in form. The machine 10 may be adapted to handle containers which are cylindrical in form, such as drums and even spherical containers or containers having oblong or other shapes. Such special containers can be handled by adapting a holding mechanism in the machine, details of which are described hereinbelow. The container 12 illustrated in the drawing is a process container and may be fitted with a mixing/liquid feed bar 14. This bar is adapted to be rotated and may have passages through which liquid is fed into the container 12 to mix with or facilitate the mixing of the dry solid material in the container.

The machine 10 has a base 16 provided by side legs 18 and 20 and one or more cross bars 22. The side legs 18 and 20 form a stanchion. The machine 10 has a drive station 24 which is journalled at 25 in the stanchion provided by the legs 18 and 20 of the base 16. This journal enables the drive station to be pivoted about an axis indicated in FIG. 1 as the "z" axis. This "z" axis is a generally horizontal axis. The drive station itself is made up of a housing 26. This housing is a shell or enclosure. At one end of the housing, which is referred to as the front end herein, a holding mechanism 28 is rotatably mounted. The mounting may be provided by a hub 30 which rotates in bearings in the front wall of the housing 26. In the alternative, the bearings may be located in a structure within housing 26. A generally "U" shaped band 32 may be used to enclose the mechanisms that are within the housing 26. Shafts 34 and 36 attached to this band 32 extend into bearings in the upper ends of the legs 18 and 20 and provide the journals which afford means for tilting the housing 26 and the entire drive station 24 about the "z" axis. Within the housing is a drive system of motors and gears which are attached to the hub 30 for driving the holding mechanism 28 with the container 12 so that the container rotates about a generally horizontal axis indicated as the "x" axis. This drive system may be a hydraulic driver using an electric motor 38 to drive a pump 40. The pump may drive a hydraulic motor 42. A gear box 44 is driven by the motor 42 and drives the hub 30 and the holding mechanism 28. In the event that a mixing bar 14 is used, it is desirable to use a coaxial shaft 46. The coaxial shaft may be provided by an inside shaft and an outer tubular shaft. The tubular shaft is connected to the hub 30 while the inner shaft extends through a clearance in the holding mechanism 28 to rotate the mixing bar 14. Liquids may be fed through the space between the coaxial shafts into a passage in the feeding bar and out through openings on the surface of the bar 14. The use of a mixing bar 14 is optional.

The holding mechanism 28 is a cantilever mechanism. In other words, it is mounted only at one end to the rotatable hub 30 while the other end is free. This mounting is at the center of a leg 48. Docking arms 50 and 52 project outwardly from the leg 48. These arms carry platforms 54 and 56, respectively. The container 12 is received between these platforms 56 and the bottom of the container in contact with the lower platform 54. The upper docking arm 52 is movable and has a shaft 58 which reciprocates in a bore 60 at the upper end of the leg 48. An actuator 62 which may be a hydraulically or pneumatically operated cylinder coerces the upper arm 52 to move toward and away from the lower arm 50.

With the upper arm 52 moved upwardly, a space is provided between the platforms 54 and 56. This space extends almost entirely around the front of the machine 10. The container 12 can readily be loaded on to the platform 54 almost from any side except directly from the rear of the machine. This facilitates loading and use of the mixing machine 10.

When the actuator 62 pulls the upper arm 52 downwardly the container 12 is clamped in the mechanism 28. The clamping forces are applied between the top and bottom of the container 12. The forces for clamping the container are compressive forces which are applied to the side walls of the container. The side walls are where the container is the strongest. Accordingly, sufficient forces may readily be applied to hold the container securely in place while it is revolved. Although a reciprocating actuator and upper arm 52 is shown, it is appreciated that the upper arm 52 can also be pivotally mounted and actuated between open and closed clamping positions by means of a suitable linkage connected to the actuator 62.

In some instances it may be desired that the container 12 be revolved about a vertical axis indicated in FIG. 1 as the "y" axis. To that end the platforms 54 and 56 may be rotatably on the arms 50 and 52. A motor 64 is hung from the bottom arm 50 and has a shaft 66 which connects to the platform 54. The platforms with the container 12 then are rotatable about the "y" axis.

The entire holding mechanism 28 is rotated about the "x" axis by means of the motor drive system in the housing 26 of the drive station 24.

The holding mechanism may be provided alternatively by a bracket which may be "U" shaped with side and back legs. The bracket may be held in a horizontal plane by a hub or boss centrally located on the back leg to the hub 30. A band or strap is secured to the side legs and receives the containers inside the bracket. The band or strap may be cylindrical so that the midsection of the container is encompassed thereby and locked in place when the band or strap is closed and/or tightened. The clamping mechanism 28 is preferred, especially for larger containers.

In accordance with another feature of this invention the drive station 24 may be tilted to an angle of inclination from zero degrees to 90 degress with respect to the vertical. This may be accomplished by tilting the entire drive station 24 about the "z" axis by means of actuators 70 and 72 which are connected between the base and the band 32 of the housing 26. The actuators 70 and 72 are shown as cylinders which may be either hydraulic or pneumatic from which rods 76 and 78 extend respectively. Eyes 80 and 82 at the upper end of the rods 76 and 78 are pivotally mounted at the band 32 and the cylinders similarly have eyes 84 and 86 which are pivotally mounted in slots 88 and 90 in the cross bar 22 of the base 16. By causing the rods 76 and 78 to pull into the cylinders of their actuator 70 and 72, the drive station 24 will be pivoted in a clockwise direction as shown in FIGS. 1 and 3, to any selected angles of inclination from 0° to 90° which enhances the blending action for the particular material in the container 12. The drive station is pivoted from a position on the side of the "z" axis about which the drive station tilts which is opposite from the holding mechanism 28. For the most part the housing 26 and the motors, pumps, gears and other mechanism of the drive system therein are located away from the "z" axis. This enables the station 24 to be counterbalanced. The configuration also is compact, making efficient use of factory floor space as well as facilitating loading and unloading of the containers. There is no unnecessary super structure which increases the cost of the machine and interferes with the loading and unloading of containers.

Figure 4:
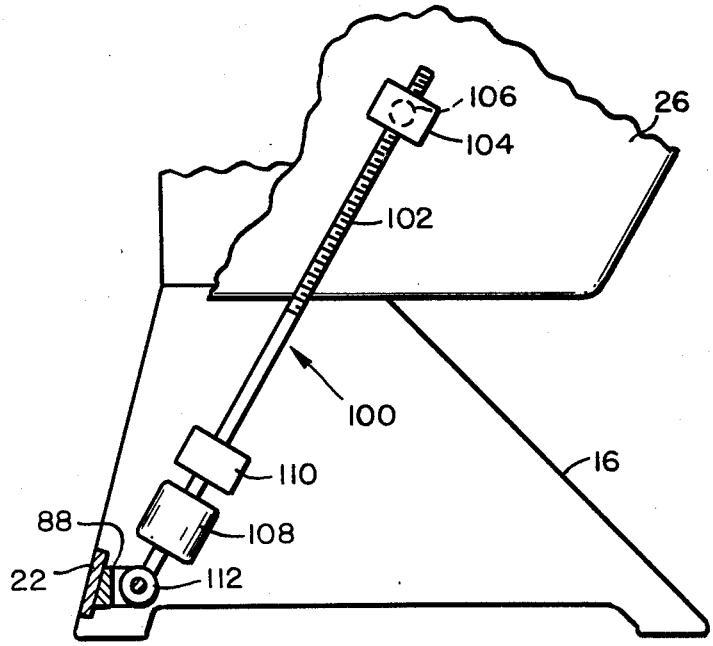
FIG. 4 is a fragmentary side view showing an actuator assembly in accordance with another embodiment of the invention for tilting the drive station of the mixing machine.

A screw type actuator 100 as shown in FIG. 4, may be used. This actuator uses a threaded rod 102 which extends at its upper end through a nut 104 which is pivotally mounted as by a shaft 106 to the band 32 of the housing 26. A motor 108 which may be a hydraulic, pneumatic, or electic motor drives a gear train 110 which turns the shaft 102. The motor 108 and the rest of the assembly may be connected to an eye 112 which is pivotally mounted in the slot 88 in the cross bar 22 as was explained in connection with the actuators 70 and 72. Accordingly, when the rod 102 is rotated it operates as a lead or feed screw and provides for precision tilting of the drive station 24.

From the foregoing description, it will be apparent that an improved mixing machine which is adapted for use with containers to mix solids which are contained therein has been described. Variations and modifications in the hereindescribed machine will undoubtedly suggest themselves to those skilled in the art. For example, an electrical drive system rather than a hydraulic drive system may be used in the housing 26 and may be preferred for those models of the machine which are adapted to handle smaller containers. Other variations and modifications will undoubtedly suggest themselves to those skilled in the art. Accordingly, the foregoing description should be taken as illustrative and not in a limiting sense.

What is claimed is:

1. A solids mixing machine for use with portable containers in which the solids to be mixed are carried, said machine comprising a base, a drive station comprising a housing, a holding mechanism for removably securing said containers to said housing, said mechanism being rotatably mounted to said housing at one end of said housing, and motor means in said housing for rotating said holding mechanism, means pivotably mounting said housing on said base, and means for pivoting said housing about said mounting means to tilt said drive station to select the angle of inclination of said container.

2. The invention as set forth in claim 1 wherein said housing has a first axis which extends generally horizontally, said mounting means has a second axis which is transverse to said first axis and also extends generally horizontally, said pivoting means being attached to said housing and said holding mechanism being mounted to said housing each on an opposite side of said second axis.

3. The invention as set forth in claim 2 wherein said pivoting means comprises an actuator having a rod which extends between said base and said housing, said actuator being connected at one end to said base and at the opposite end to said housing.

4. The invention as set forth in claim 3 wherein said actuator is a hydraulically, pneumatically, or electrically operated cylinder, said rod being reciprocally mounted in said cylinder for reciprocating said rod.

5. The invention as set forth in claim 3 wherein said rod has a screw thread, an internally threaded member in which said rod is disposed, said actuator has means for rotating one of said rods and internally threaded member, and means for attaching said rod and said internally threaded member separately to said base and said housing.

6. The invention as set forth in claim 3 further comprising means on said housing and on said base for pivotally mounting said actuator both to said base and to said housing.

7. The invention as set forth in claim 2 wherein said housing is an enclosure, said motor means being disposed within said enclosure and said enclosure and motor means being disposed essentially entirely on the side of said axis opposite to said holding means whereby to aid in counterbalancing said holding means and container.

8. The invention as set forth in claim 2 wherein said base has a pair of legs spaced from each other along said second axis to define a space therebetween, said housing being disposed in said space between said legs, said pivotal mounting means comprising shaft means extending along said second axis from opposite sides of said housing and journals in said legs in which said shaft means are received.

9. The invention as set forth in claim 2 wherein said holding mechanism is a cantilever structure defining an opening for receiving one of said containers said opening extending essentially in a horizontal place around said one end of said housing.

10. The invention as set forth in claim 9 wherein said holding mechanism is a clamping mechanism and said structure is generally "U" shaped having arms, at least one of said arms being movable with respect to the other to clamp said container therebetween.

11. The invention as set forth in claim 10 wherein said "U" shaped structure has a leg, said leg having a central region which is mounted to said housing with said leg being generally perpendicular to said first axis, said arms extending longitudinally from opposite ends of said legs generally along said second axis.

12. The invention as set forth in claim 11 wherein an actuator is mounted in said leg and connected to the movable one of said arms for moving said one arm into and out of clamping relationship with said container.

13. The invention as set forth in claim 12 wherein platforms are mounted on each of said arms for receiving said container respectively at the top and bottom thereof and applying compressive forces to the sides of said container via the top and bottom thereof.

14. The invention as set forth in claim 13 wherein means are provided for rotatably mounting said platforms on said arms for rotation about a third axis generally perpendicular to both said first and second axis, and motor means for revolving one of said platforms.

15. A solids mixing machine for use with a portable container in which solids are carried, said container having a side wall with a top and a bottom at opposite ends of said side wall, said machine comprising a support structure, a rotatable member mounted in said support structure and having an axis of rotation, a cantilever mechanism for holding said container, said mechanism having a leg member, and a pair of clamping arm members, said leg member being attached to said rotatable member on one side thereof and to said arm members on the opposite side thereof such that said arm members project away from said rotatable member and said support structure, said arm members being spaced from each other so as to receive said container with said side wall extending along said leg member and said top and bottom disposed opposite said arm members, at least one of said arm members being movable in said leg member toward and away from the one of said top and bottom opposite to which it is disposed so as to apply compressive forces to said side wall and clamp said container in said holding mechanism, and driving means mounted in said support structure for continuous rotation of said rotating member together with said holding mechanism 360° about said axis so as to revolve said container and mix the solids therein.

16. The invention as set forth in claim 15 wherein said cantilever mechanism also has a pair of platforms respectively for receiving the top and bottom of said container, said platforms being mounted opposed to each other each on a different one of said arms along an axis perpendicular to the axis of rotation of said rotatable member, and motor means mounted on one of said arms for rotating the platform mounted thereon whereby to revolve said container about both said axis.

17. The invention as set forth in claim 15 wherein said cantilever mechanism also has actuator means in said leg and attached to the one of said arms which is movable for advancing and retracting said movable arm.

18. The invention as set forth in claim 15 wherein said support structure comprises a housing, a base defining a stanchion, said housing being journalled to said stanchion to pivot along an axis perpendicular to the axis of rotation of said rotatable member, said cantilever mechanism being disposed on one side of said pivot axis and means for tilting said housing about said pivot axis to select the angle of inclincation of said container, said pivot means being connected to said housing at a location spaced from said pivot axis on the opposite side of said pivot axis from said cantilever mechanism.

19. The invention as set forth in claim 18 wherein said tilting means comprises an actuator connected between said base and said housing.

20. The invention as set forth in claim 19 wherein said housing is an enclosure, bearings in said housing in which said rotatable member is journalled, and motor means for driving said member also in said container, said enclosure and said motor means being disposed substantially entirely on said opposite side of said pivot axis so as to counterbalance said cantilever mechanism and container.

* * * * *

UNITED STATES PATENT OFFICE

CERTIFICATE OF CORRECTION

PATENT NO. : 4,146,335

DATED : Mar. 27, 1979

INVENTOR(S) : Hutchings et al.

It is certified that error appears in the above-identified patent and that said Letters Patent are hereby corrected as shown below:

Column 8, line 23 "inclincation" should be --inclination--.

Signed and Sealed this

*Thirty-first* Day of *July 1979*

[SEAL]

*Attest:*

*Attesting Officer*

LUTRELLE F. PARKER

*Acting Commissioner of Patents and Trademarks*